United States Patent [19]

Nakayama et al.

[11] 3,981,629

[45] Sept. 21, 1976

[54] SWASH-PLATE TYPE COMPRESSOR FOR AIR CONDITIONING OF VEHICLES

[75] Inventors: Shozo Nakayama; Takeshi Toriyama, both of Kariya; Takeshi Higuchi, Ohbu, all of Japan

[73] Assignee: Kabushiki Kaisha Toyoda Jidoshokki Seisakusho, Japan

[22] Filed: Sept. 15, 1972

[21] Appl. No.: 289,727

[30] Foreign Application Priority Data

Sept. 21, 1971 Japan ..... 46-86057[U]

[52] U.S. Cl. ..... 417/269

[51] Int. Cl.[2] ..... F04B 1/12

[58] Field of Search ..... 417/269, 270; 74/60

[56] References Cited

UNITED STATES PATENTS

| | | | |
|---|---|---|---|
| 2,835,436 | 5/1958 | Steinhagen et al. | 417/269 |
| 2,877,653 | 3/1959 | Masnik et al. | 74/60 |
| 2,925,047 | 2/1960 | Hoffer | 74/60 |
| 3,057,545 | 10/1962 | Ransom et al. | 417/269 |
| 3,067,694 | 12/1962 | Fancher | 417/269 |
| 3,352,485 | 11/1967 | Niki et al. | 417/269 |
| 3,361,077 | 1/1968 | Freeman | 417/269 |
| 3,380,651 | 4/1968 | Niki et al. | 417/269 |
| 3,577,891 | 5/1971 | Katsuta | 417/269 |

*Primary Examiner*—William L. Freeh
*Assistant Examiner*—G.P. LaPointe
*Attorney, Agent, or Firm*—Burgess Ryan and Wayne

[57] ABSTRACT

A swash-plate type compressor for air conditioning of vehicles. A pair of cylinder blocks are rigidly combined in coaxial alignment. The combined cylinder blocks form three bores. A piston is slidably disposed in each bore and the motion of each piston is actuated by a swash-plate mechanism mounted on a drive shaft which is connected to a driving source. A lubrication reservoir is formed in a sector space sandwiched by a pair of said bores and an inside wall of said combined cylinder block. A geometrical longitudinal center line of said combined cylinder block is biased downward from a geometrical center line of said drive shaft.

3 Claims, 2 Drawing Figures

SWASH-PLATE TYPE COMPRESSOR FOR AIR CONDITIONING OF VEHICLES

BRIEF SUMMARY OF THE INVENTION

The present invention relates to a swash-plate type compressor for air conditioning of vehicles. More particularly it relates to an improvement of a swash-plate type compressor wherein a combined cylinder block forms the outer surface of the compressor instead of utilizing a frame which is referred to as a shell or a casing of the conventional compressor.

Recently in the development of vehicles, there has been a tendency to restrict the space occupied by the auxiliary machine parts or restrict the weight thereof. Consequently, requirements have arisen for a smaller size and lighter weight compressor for the vehicle.

It is well known that the swash-plate type compressor has a greater capability than a reciprocation type compressor. Moreover, the swash-plate type compressor is more desirable because of its reduced vibration and low noise. However, against the above-mentioned advantages, of the conventional swash-plate compressor, it is comparatively larger in size, heavier in weight and requires many separate machine parts. Consequently, in the automobile industry, a continuing requirement has been to find a way to solve the above-mentioned problems without losing the advantages.

Several improvements have been attempted to solve the above-mentioned problems. In one of these improvements, a compressor having a cylindrical shell is utilized. A geometrical center axial-line of the outside cylindrical surface of the cylinder block coincides with a geometrical center line of the driving shaft. This arrangement leaves an insufficient space for storing of the lubrication oil, hereinafter referred to as an oil reservoir. In other words, in the above-mentioned arrangement, the lower most profile of the swash-plate is positioned close to the bottom surface of the oil reservoir and, as a result, the lubrication oil returned to the oil reservoir is splashed by the rotating swash-plate directly. The splashed particles of the lubrication oil move into the cylinder bore through the suction and ejection of the piston, are there compressed together with the refrigerating gas, and then carried to the refrigeration circuit. Consequently, it is impossible to store lubrication oil in the oil reservoir. Naturally, under such an arrangement, as the refrigerating gas is compressed together with the splashed particles of the lubrication oil, the compression efficiency, from the viewpoint of gas volume, is lowered so that the refrigeration capacity is lowered. Further, although the compressor requires sufficient and prompt lubrication as soon as it is started, the lubrication action of this compressor is insufficient and, therefore, the durability of the compressor is also reduced. One proposed solution to this problem was to use a cylindrical block provided with a projected oil reservoir expanded outside the bottom portion thereof. This type of swash-plate compressor is disclosed in a co-pending patent application, Ser. No. 188,897 filed on Oct. 13, 1971. However, as this type of compressor requires more space for the outwardly expanded oil reservoir, it increases the already mentioned size disadvantage of swash-plate compressors.

The object of the present invention is to solve the above-mentioned problems.

In the improvement of the swash-plate compressor according to the present invention, a geometrical center line of the driving shaft is eccentrically positioned above a geometrical longitudinal center line of an outer cylindrical surface of the combined cylinder block. The combined cylinder block forms a main body of the compressor, wherein a shell is omitted, so as to enlarge a lower portion of the space formed in the cylinder block.

Further features and advantages of the invention will be apparent from the ensuing description with reference to the accompanying drawings, to which the scope of the invention is in no way limited.

DETAILED DESCRIPTION OF THE INVENTION

Figure 1:
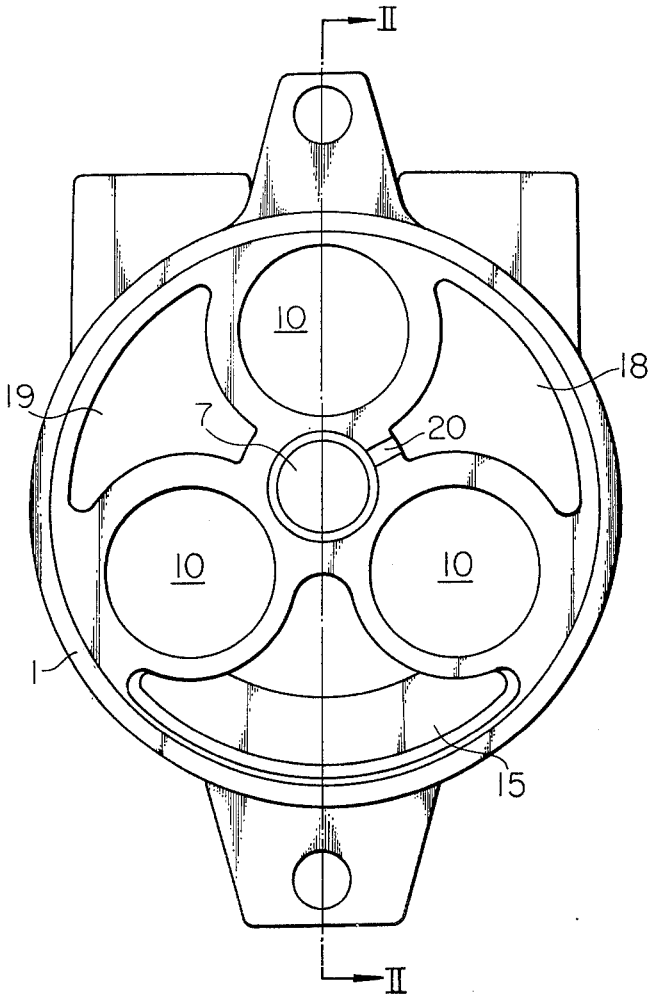
FIG. 1 is a front view of the housing of the swash-plate compressor according to the present invention.
Figure 2:
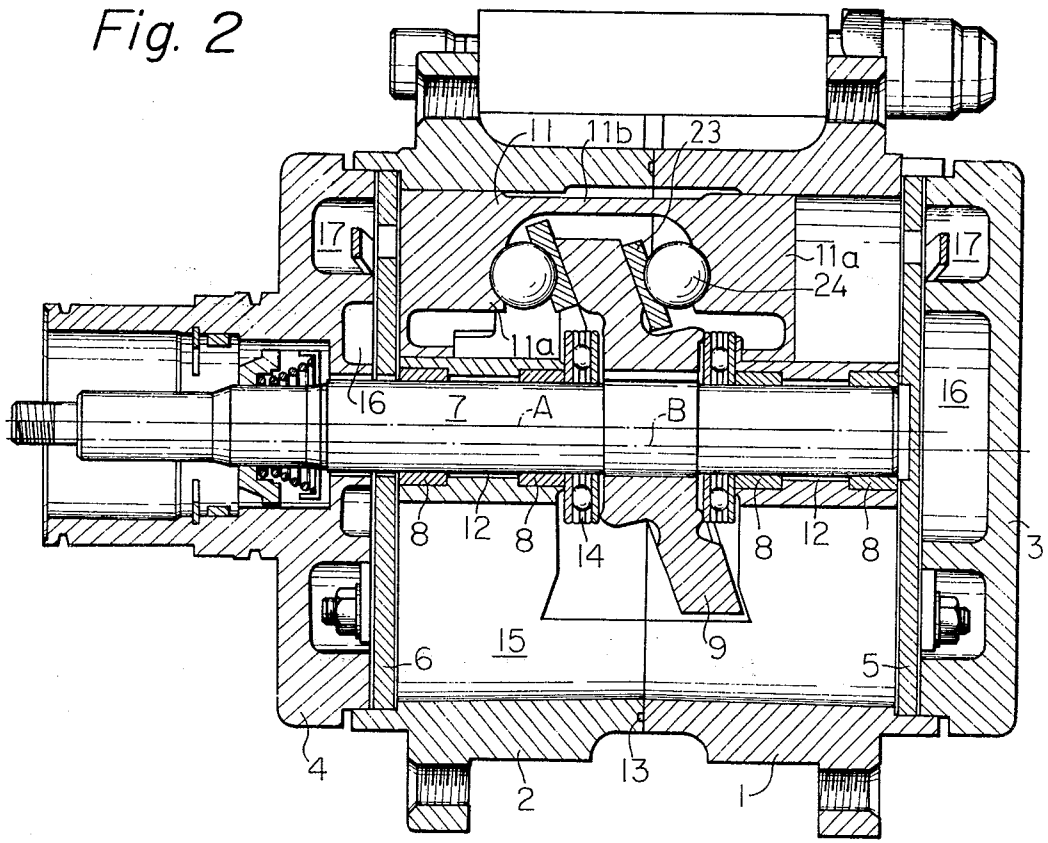
FIG. 2 is a transverse sectional view of the swash-plate compressor, taken along the line II—II in FIG. 1.

Referring to FIGS. 1 and 2, an embodiment of the swash-plate compressor according to the present invention, comprises, in its essential parts, a pair of cylinder blocks 1 and 2 combined with each other in an axial alignment. This combination is accompanied by a pair of cylinder heads 3 and 4, which are rigidly attached to outer ends of both cylinder blocks 1 and 2 in an axial alignment, respectively. In the above-mentioned assemblage, a ring seal 13 is utilized as shown in FIG. 1. Between the front cylinder head 4 and the front cylinder block 2, a valve plate 6 is fixedly inserted, keeping the prescribed positional relationship. Another valve plate 5 is provided for the rear cylinder head 3 and block 1. Coaxially passing through the blocks, heads and plates, a drive shaft 7 provides a direct connection with a drive part (not shown) of the drive engine of the vehicle. The drive shaft 7 is rotatably mounted on needle bearings 8 provided at the outer ends of the blocks 1 and 2. In the above-mentioned structure, it is important to realize the relative disposition of the drive shaft 7 to the coaxial geometrical center line B of the cylinder blocks 1 and 2, and the cylinder heads 3 and 4. That is, the geometrical center line A of the drive shaft 7 is positioned a little above the coaxial geometrical center line B.

All of the bores 10, that is, triple pairs of bores 10, run substantially parallel to the axis of the drive shaft 7 and are provided with double acting pistons 11 slidably inserted therein.

The piston 11 comprises a pair of end bosses 11*a* which are in close sliding contact with the inner wall of the bore 10, and a connecting part 11*b* of the two bosses 11*a*. The connecting part has recesses for engagement with both faces of the swash-plate 9 via balls 24 and shoes 23 disposed therein. Due to this engagement, rotation of the swash-plate 9 causes reciprocal sliding of the piston 11 within the bore 10. A pair of thrust bearings 14 are disposed between the boss of the swash-plate 9 and the cylinder blocks 1 and 2 so as to assume the axial thrust load caused by the pumping action of the piston 11. Sectional chambers are formed in the spaces enclosed by the neighbouring bores 10 and the outer wall of the blocks 1 and 2. The bottom sector chamber is used for a lubricant reservoir 15 and the other two for refrigerant passageway 18 and 19, which communicate with the respective suction chambers 16 and discharge chambers 17 of the cylinder heads 3 and 4.

After circulation through the refrigerating circuit, the refrigerant returns to the compressor, and is led into an inlet port (not shown) and distributed equally to the refrigerant passageway 18 formed in both cylinder blocks 1 and 2. The lubrication oil contained in the refrigerant is separated from the suction refrigerant, and the separated lubrication oil is led into shaft bores 12 through oil grooves 20. This lubrication oil is distributed to each sliding portion, such as the needle bearings 8, thrust bearings 14 and the swash-plate 9, for lubrication thereof.

After separation of the oily content, the oil free refrigerant is conducted into the suction chamber 16 of both cylinder heads 3 and 4 through the valve plates 5, 6. From there the refrigerant is sucked into the cylinder bores 10 by operation of a suitable suction valve (not shown). The compressed refrigerant is then discharged into the discharge chambers 17 of the heads 3, 4 by a suitable discharge valve (not shown); next, into the refrigerant passageways 19, via the conduits of the valve plates 5, 6, and; finally, towards an outlet opening (not shown) via outlet ports (not shown). The similar construction and dispositions of the inlet, outlet openings and ports disclosed in the above-mentioned copending patent application can be applied to the present invention. The lubricant reservoir 15 receives the excess of the lubrication oil, and feeds this oil to the swash-plate 9 for lubrication and circulation.

As mentioned above, in the swash-plate compressor according to the present invention, wherein the shell is omitted, the geometrical center line of the cylinder blocks is biased a little below the geometrical center line of the driving shaft. Consequently, in spite of the fact that the cylinder blocks encases the oil reservoir and refrigerant passageway, the construction thereof is very simple. Further, the space required by the compressor is almost the same as in the case of utilizing a true cylindrical cylinder block, even though sufficiently large space for reserving lubrication oil can be formed therein. As already mentioned, a very simple sealing method is applied by utilizing the ring seal 13.

Consequently, the seal system for for sealing the refrigerant passageway can be completely eliminated and the possible gas leakage can be perfectly prevented.

What is claimed is:

1. In a shell elimination type swash plate compressor for air conditioning vehicles, of the type having a pair of cylindrical cylinder blocks combined with each other in axial alignment and forming the outer surface of the compressor body, a pair of cylinder heads coaxially connected to the outer ends of said combined cylindrical cylinder blocks by way of valve plates, each cylinder head having a suction chamber and a discharge chamber, said combined cylindrical cylinder blocks having three axially aligned bores extending therein, a piston slidably held in each bore, a drive shaft connected to a driving source, and a swash plate mechanism for moving said pistons and rigidly mounted on said drive shaft; the improvement wherein said drive shaft is mounted with its center line axially extending and located radially spaced from the geometrical longitudinal center line of said combined cylindrical cylinder blocks, and said three bores are disposed with equiangular spacing on a circle about said center line of said drive shaft whereby one of the three sector spaces defined by adjacent pairs of said three bores and an inside wall of said cylindrical cylinder blocks has a volume larger than those of the remaining two sector spaces, said larger volume sector space having a lubrication reservoir formed therein, said swash plate mechanism extending into said reservoir, whereby the periphery of said swash plate mechanism is farther from the outer wall of said cylinder blocks in the region of said reservoir than in a region of the cylinder blocks diametrically opposite said reservoir.

2. A shell elimination type swash plate compressor as claimed in claim 1, wherein said lubrication reservoir chamber extends axially throughout said combined cylindrical cylinder blocks, and said valve plates serve as walls for said chamber.

3. A shell elimination type swash plate compressor as claimed in claim 1, comprising a ring seal mounted at the junction of said cylindrical cylinder blocks.

* * * * *